United States Patent [19]

Bowman

[11] Patent Number: 4,508,496

[45] Date of Patent: Apr. 2, 1985

[54] ROTARY, POSITIVE-DISPLACEMENT MACHINE, OF THE HELICAL-ROTOR TYPE, AND ROTORS THEREFOR

[75] Inventor: James L. Bowman, Mooresville, N.C.

[73] Assignee: Ingersoll-Rand Co., Woodcliff Lake, N.J.

[21] Appl. No.: 571,109

[22] Filed: Jan. 16, 1984

[51] Int. Cl.[3] ..... F01C 1/16

[52] U.S. Cl. ..... 418/201; 418/150

[58] Field of Search ..... 418/150, 201

[56] References Cited

U.S. PATENT DOCUMENTS

| | | | |
|---|---|---|---|
| 3,787,154 | 1/1974 | Edstrom | 418/201 |
| 4,088,427 | 5/1978 | Emanuelsson | 418/201 |
| 4,412,796 | 11/1983 | Bowman | 418/201 |

*Primary Examiner*—Leonard E. Smith

*Assistant Examiner*—Jane E. Obee

*Attorney, Agent, or Firm*—B. J. Murphy

[57] ABSTRACT

The machine, in the embodiment shown, is an air (or gas) compressor having a housing with parallel, intersecting bores in which are rotatably journaled coacting, meshing helical rotors. The rotors, male and female, are of the asymmetrical type. Confronting concave and convex surfaces of portions of the grooves and lobes of the rotors, for having different arcuate conformations along principal lengths thereof, define a void of varying width therebetween. However, other, minor extents of the confronting surfaces are defined of a common arc and, therefore, nestably conform with each other (a) to reduce contact stress therebetween, (b) to improve rotor-to-rotor sealing, and (c) to accommodate therebetween a significant film of oil.

22 Claims, 4 Drawing Figures

ROTARY, POSITIVE-DISPLACEMENT MACHINE, OF THE HELICAL-ROTOR TYPE, AND ROTORS THEREFOR

This invention pertains to rotary, positive displacement machines of the screw or helical rotors type, particularly adapted for use as a fluid compressor such as an air compressor, and to rotors for use in such machines. The invention is particularly characterized by novel rotor profiles which improve machine efficiency, reduce costs, and enhance durability.

More particularly, this invention relates to rotary machines of the aforesaid type which include a housing having at least one pair of intersecting bores therein. Inlet and outlet ports are provided at opposite ends of the casing bores. A rotor is mounted for rotation within each of the bores. One of these rotors is of the male type which includes a plurality of helical lobes and intervening grooves which lie substantially completely outside the pitch circle thereof with the flanks of the lobes having a generally convex profile. The other rotor is of the female type and formed so that it includes a plurality of helical lobes and intervening grooves which lie substantially completely inside the pitch circle thereof with the flanks of the grooves having a generally concave profile. The lobes on the male rotor cooperate with the grooves of the female rotor and the walls of the casing to define chambers for fluid. These chambers may be considered to be chevronshaped. Fluid to be compressed enters the casing bores through the inlet port and is trapped in the chambers formed between the grooves of the female rotor and the walls of the associated casing bore. As the rotors rotate, these chambers move from the inlet port toward the outlet port and the volume of the chambers decreases to thereby compress the gas in the chamber. When communication is established with the outlet port, compressed gas is discharged from the casing.

The construction and design of rotor profiles for the type of machine to which the present invention relates has been the subject of a great deal of consideration. The rotor profile is considered to be the configuration of the rotor in a plane transverse to the longitudinal axis of the rotor. Of particular concern is the configuration of the lobes and grooves on the male and female rotors. This work has concentrated on efforts to design a machine with a large displacement and high volumetric efficiency.

Generally, there are considered to be three basic rotor profile designs. These may be classified as the generated profile, the circular profile and the asymmetrical profile. The present invention is directed to the asymmetrical design.

U.S. Pat. No. 2,287,716 issued to J. E. Whitfield is representative of a generated rotor profile. The details of the generated design need not be considered here as they are generally known to those skilled in the art and may be obtained from the above mentioned U.S. patent. The primary advantage of the generated profile is that this design permits a large displacement volume. The generated profile has the further advantage that no "blow holes" are formed as the rotors rotate. A blow hole allows communication between adjacent volumes being compressed. The fluid being compressed will flow from the high pressure volume to the low pressure volume which will result in a reduction in compressor efficiency. The lack of such blow holes adds to the efficiency of the generated profile.

The generated profile does, however, have its disadvantages. The generated profile has a long sealing line between the male and female rotors. This long sealing line means that there is a large area through which fluid may leak from the working space directly to the low pressure side of the machine. This leakage will reduce the volumetric efficiency of the machine. An additional disadvantage of this design is that large clearances must be used between the two rotors in order to prevent damage to the rotors and the entire machine in the event the two rotors are not properly timed in relation to each other. Because of the long sealing line, these large clearances will increase the losses due to leakage and effect volumetric efficiency. A further disadvantage of the point generated profile is that large closed pockets are formed between the lobes on the male rotor and the grooves in the female rotor. These pockets trap fluid thereby reducing volumetric efficiency of the machine. In addition, as the rotors rotate, this trapped fluid is compressed and produces a negative torque counteracting the rotation of the machine and creating a bending moment on the female lobes. This requires that the thickness of these lobes be increased thereby reducing the displacement volume of the machine.

U.S. Pat. No. 2,622,787 to H. R. Nilsson is representative of the circular profile design. The circular profile design is generally well known and in popular use in air and gas compressors. The circular profile design has the advantages that no closed pockets are formed and no fluid is trapped in such closed pockets. This permits the lobes on the female rotor to be reduced in thickness because negative torque is not created. Because the female rotor lobes can be reduced in thickness, the displacement of the machine for any given size can be increased. This design has the further advantage that the sealing line is much shorter than in the generated design. The reduction in length of the sealing line reduces losses and increases volumetric efficiency.

The primary disadvantage of the circular profile design is that it has a small displacement volume when compared with the generated profile. The circular profile has the further disadvantage that large blow holes are formed permitting communication between adjacent volumes being compressed. This reduces the adiabatic efficiency of the machine and virtually offsets the gain made by the reduction in the length of the sealing line and the absence of closed pockets.

The asymmetrical profile combines the advantages of both the circular profile and the generated profile. In the asymmetrical design, one of the flanks of the groove in the female rotor is generated and one of the flanks is circular. The asymmetrical profile has the advantage that there is a reduction in the length of the sealing line as compared with the generated profile thereby reducing losses due to friction and leakage associated with a long sealing line. In addition, this profile reduces the size of the trapped pocket as compared with the generated profile and thereby reduces the losses and difficulties associated with a large trapped pocket. With respect to the circular profile, the asymmetrical profile has the advantage that there is a substantial reduction in the size of the blow hole and the losses associated with such a large blow hole. In addition, the displacement volume is substantially larger than with the circular profile although it is smaller than with the generated profile.

The asymmetrical profile is, per se, generally well known and disclosed in U.S. Pat. Nos. 2,174,522 issued to A. Lysholm, 2,473,234 issued to J. E. Whitfield, 3,414,189 issued to J. E. Persson and 3,423,017 issued to L. B. Schibbye. These last two patents are useful in comparing the various rotor profile designs. In addition, my own U.S. Pat. No. 4,412,796, issued on 1 Nov. 1983, for Helical Screw Rotor Profiles, defined asymmetrical designs which provide pressure angle, and other, improvements, having especial utility in machines in which the male rotor drives the female rotor.

Female rotor drive, i.e., where the female rotor drives the male rotor, which is sometimes a preferred arrangement, poses a problem which doesn't arise in the alternative arrangement. In the latter circumstance, the female rotor sees about five percent of the torque. In the female drive situation, the female rotor sees about ninety-five percent of the torque. Now then, this being the case, the contact stress of the female rotor flanks would be excessive and, to meet this, the female rotor needs to be formed of metal of a greater than standard hardness. Of course, this curative measure causes a significant increase in the manufacturing cost of the rotors—the female rotors.

It is an object of this invention to set forth improved, asymmetrically profiled rotors, both male and female, which may be formed of metal of only standard hardness, and which nonetheless accommodate female drive without undue contact stress of the female rotor flanks.

It is also an object of this invention to set forth rotors, as aforesaid, which exhibit improved sealing therebetween and, consequently, yield a more efficient performance.

Another object of this invention is to disclose rotors, as aforesaid, which facilitate an improved hydrodynamic lubrication therebetween.

Particularly, it is an object of this invention to set forth a rotor, having helical lobes, and intervening, helical grooves, rotatable about a given axis within a machine housing, for coacting, meshing engagement with a cooperating rotor also having helical lobes, and intervening, helical grooves, in order that fluid admitted into such housing will be received in said grooves and, due to coacting, meshing engagement and rotation of said rotors, will have the pressure thereof altered, wherein said rotor has an axial center; each of said grooves of said rotor has, in crosssection, a pair of generally concave surfaces, and a first, radially innermost point intermediate said pair of surfaces; and said rotor has a pitch circle; wherein a line traversing said axial center and said first point further traverses a second, given point on said pitch circle; only a minor portion of one of said concave surfaces is defined by a circular arc which (a) traverses said pitch circle, and (b) has a given radius originating at said second point; and said minor portion is bounded by a third point which is located on said pitch circle whereat said arc traverses, and a fourth point which is at a prescribed distance inward of said pitch circle.

It is further an object of this invention to set forth a rotor, having helical lobes, and intervening, helical grooves, rotatable about a given axis within a machine housing, for coacting, meshing engagement with a cooperating rotor also having helical lobes, and intervening, helical grooves, in order that fluid admitted into such housing will be received in said grooves and, due to coacting, meshing engagement and rotation of said rotors, will have the pressure thereof altered, wherein said rotor has an axial center; each of said lobes of said rotor has, in cross-section, a pair of generally convex surfaces, and a radially outermost point intermediate said pair of surfaces; and said rotor has a pitch circle; wherein a line traversing said axial center and a first point defined by said radially outermost point of said lobe further traverses a second, given point on said pitch circle; only a minor portion of one of said convex surfaces is defined by a circular arc which (a) traverses said pitch circle, and (b) has a given radius originating at said second point; and said minor portion commences at a third point, along said one convex surface, which is at a prescribed distance outward from said pitch circle, and subsists along a length of said arc, which length is of the same dimension as said prescribed distance, to a fourth point along said one convex surface.

Yet another object of this invention is to disclose a rotary, positive displacement machine, having a housing, adapted to handle a working fluid in that it has rotors rotatable about parallel axes, within said housing, said rotors each having helical lobes and intervening, helical grooves, for coacting, meshing engagement in order that fluid admitted into said housing will be received in said grooves and, due to coacting, meshing engagement, and rotation, of said rotors, will have the pressure thereof altered, wherein each of said rotors has an axial center; each of said grooves of one of said rotors has, in cross-section, a pair of generally concave surfaces and a radially innermost point intermediate said concave surfaces; each of said lobes of another of said rotors has, in cross-section, a pair of generally convex surfaces and a radially outermost point intermediate said convex surfaces; and said rotors have pitch circles; wherein a line traversing said axial center, and both said innermost and outermost points, at a first, common, point of coincidence, further traverses a second, given point common to both of said pitch circles; only a minor portion of one of said concave surfaces and only a minor portion of one of said convex surfaces are both defined by a circular arc which (a) traverses said pitch circles of said rotors, and (b) has a given radius originating at said second point; and said minor portions are bounded by a third point located on said pitch circle of said one rotor whereat said arc traverses, and a fourth point which is at a prescribed distance inward of said pitch circle of said one rotor.

Further objects of this invention, as well as the novel features thereof, will become more apparent by reference to the following description, taken in conjunction with the accompanying figures, in which.

Figure 3:
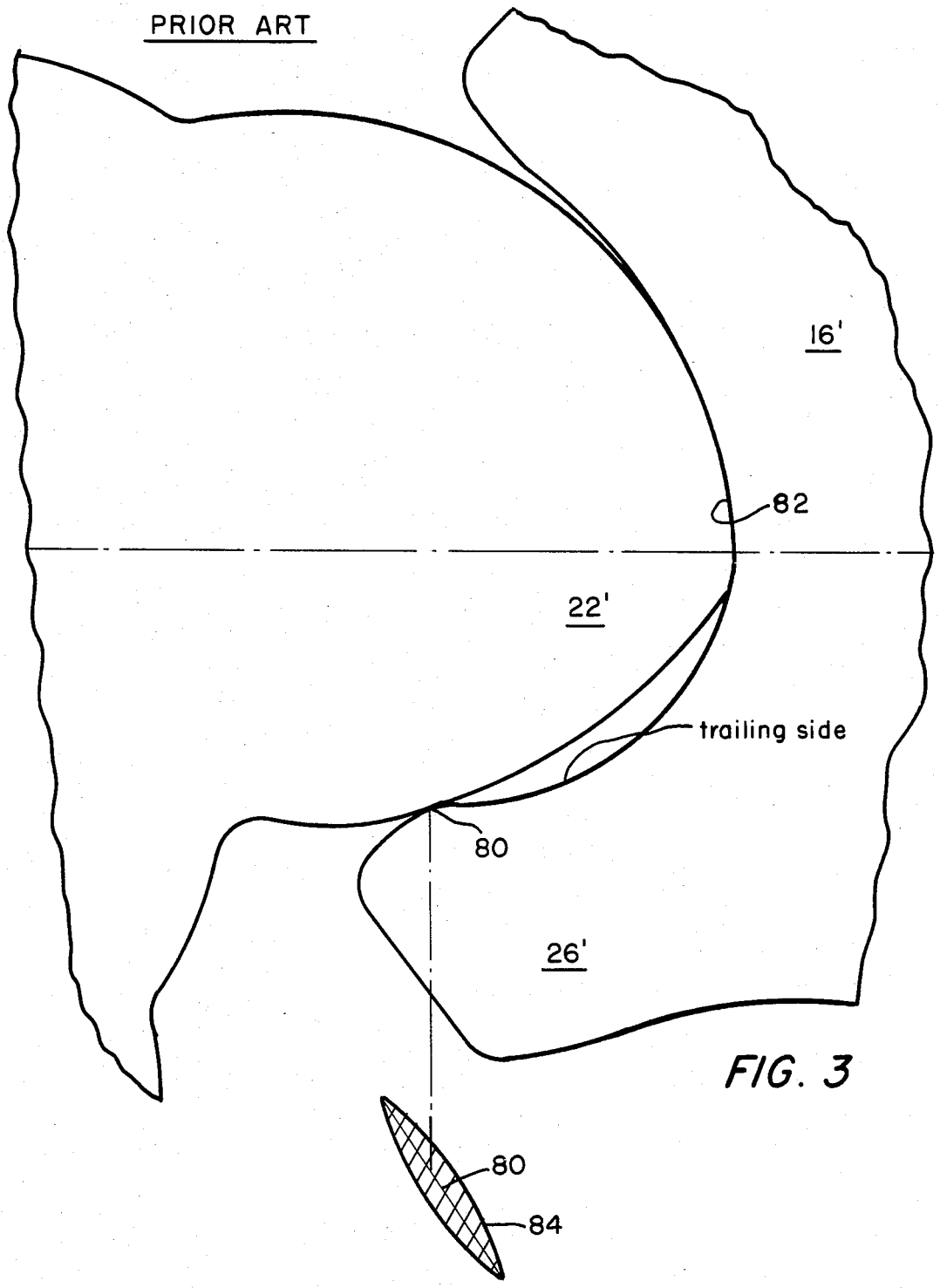
Figure 4:
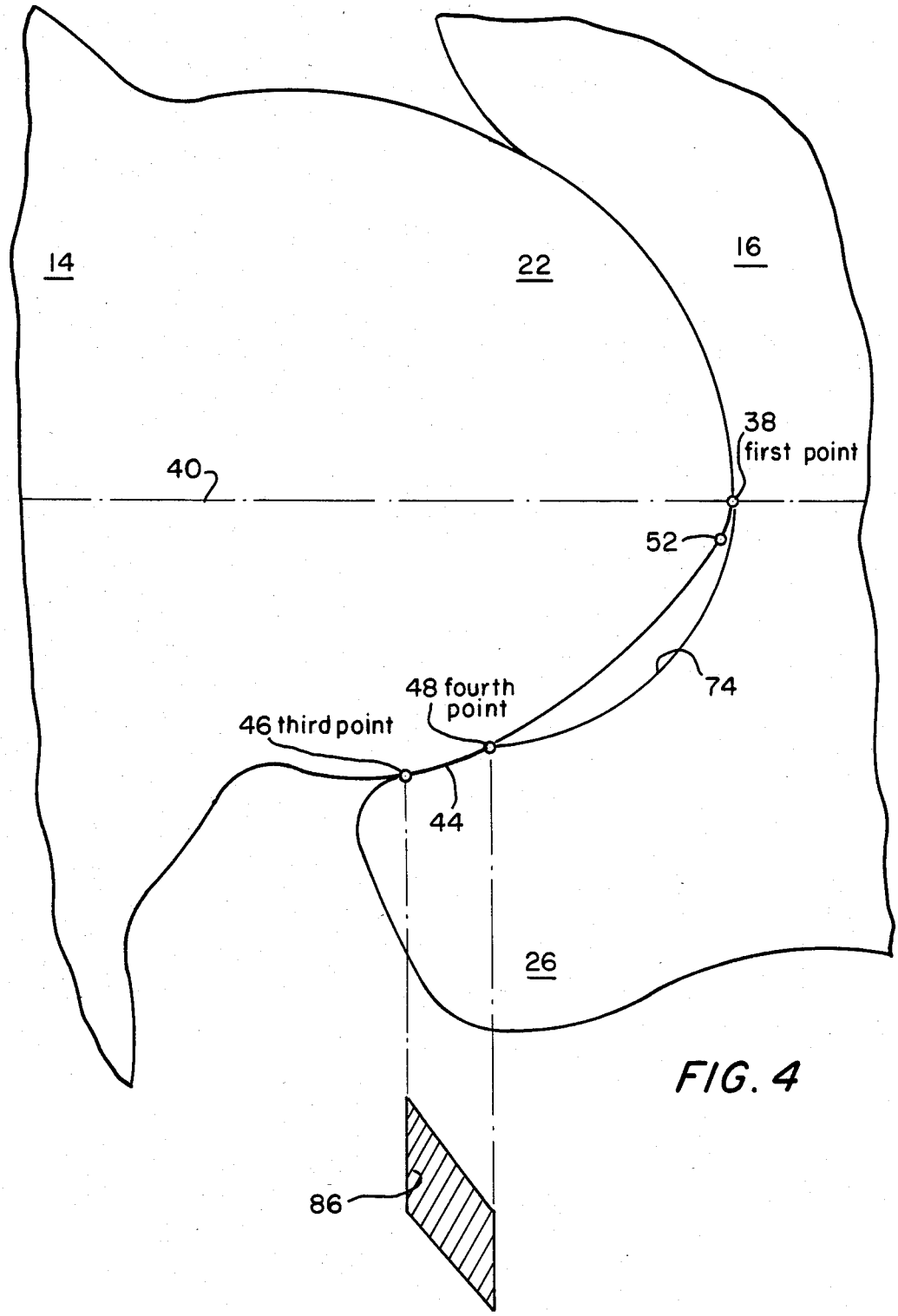

FIG. 3 is a line drawing denoting the location of the severe contact stress which obtains in prior art, asymmetrical rotor profiles employing female rotor drive, as well as an idealized projection, in a plane transverse to the line drawing, of the theoretical contact line and adjacent deformed areas; and FIG. 4 is a line drawing, and idealized projection, similar to FIG. 3, depicting the improved contact stress situation obtaining the female drive arrangements employing the rotor profiles of the instant invention.

As shown in the figures, a rotary, positive displacement machine 10 comprises a housing 12 with a male rotor 14 and female rotor 16 rotatable therewithin on parallel axes 18 and 20, respectively. The male rotor 14 has four helical lobes 22 and four intervening grooves 24. The female rotor 16 has six helical lobes 26 and six intervening grooves 28. Male rotor 14 has a pitch circle 30, and female rotor 16 has a pitch circle 32.

Each male rotor lobe 22 has a pair of generally convex surfaces 34 and 36, and a first, radially outermost point 38 intermediate surfaces 34 and 36. A line 40 traversing the axial center 18 and the first point 38, also traverses a second point 42 on the pitch circle 30. A minor portion 44 of surface 36 is defined by a circular arc which: (a) has its origin at the second point 42, and (b) traverses the pitch circle 30. Minor portion 44 commences at a third point 46, along the surface 36, which is a prescribed distance "D" outward from the pitch circle 30, and subsists along a length which is of the same dimension "D" to a fourth point 48.

Each male rotor lobe, and groove, is further defined as follows. The profile portion of each lobe 22, from first point 38 to a fifth point 50 is a circular arc with its radial center at second point 42. The very minor portion, between first point 38 and a point 52 thereadjacent, is an arc of decreasing radius from point 38 to point 52. The profile portion between point 52 and the fourth point 48 is a curve generated by the point on the female rotor 16 which, in FIGS. 1 and 2, confronts the fourth point 48. Points 54 and 56, and 58 and 60 each define therebetween, respectively, circular arcs drawn from axis 18. The portions between point 56 and 62, and between point 62 and the fifth point 50, are generated, respectively, by the portion of the female lobe 26 subsisting between points 64 and 66, and the portion of the female lobe 26 subsisting between point 66 and the point thereon which, in FIGS. 1 and 2, confronts the fifth point 50. The short radius turn on the male rotor 14 between point 58 and a point 68 thereon is a generated surface generated by the surface of the female lobe 26 which obtains between the point thereon confronting the third point 46 and an adjacent point 70. Finally, the profile portion of the male rotor between point 68 and the third point 46 is an epicycloid generated by the point on the female rotor 26 which, in FIGS. 1 and 2, confronts the third point 46.

As it may be useful to an understanding of the preceding description, the following is a tabulation of the male rotor profile portions:

54–56, a circular arc drawn from axis 18;
56–62, a generated portion;
62–50, a generated portion;
50–38, a circular arc drawn from point 42;
38–52, an arc of decreasing radius toward point 52;
52–48, a generated portion;
48–46, a circular arc drawn from point 42;
46–68, a generated epicycloid;
68–58, a generated portion; and
58–60, a circular arc drawn from axis 18.

Figure 1:
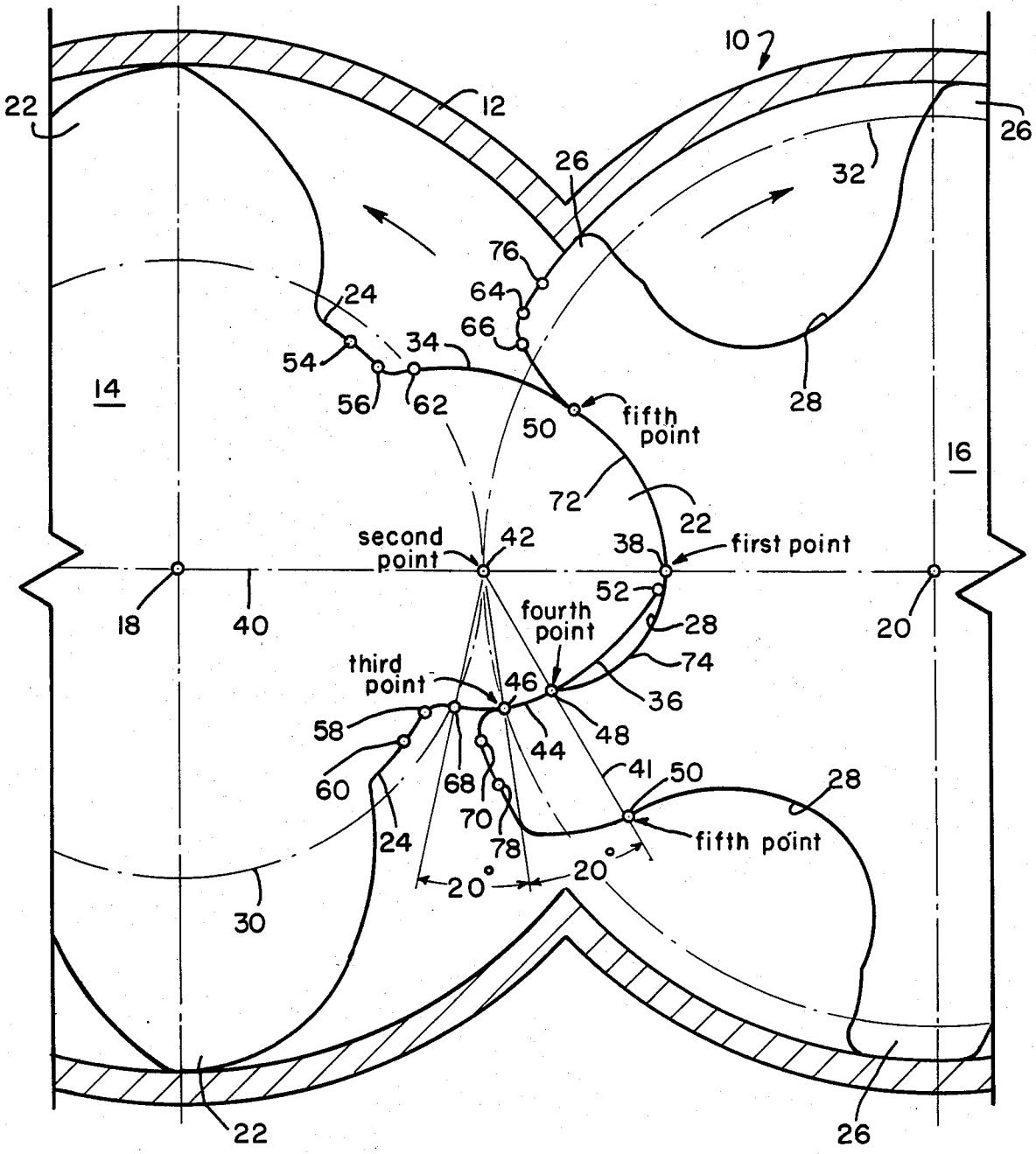
FIG. 1 is a line drawing of the principal portions of profiles of coacting male and female rotors, within a machine housing (shown cross-sectioned), according to an embodiment of the invention.
Figure 2:
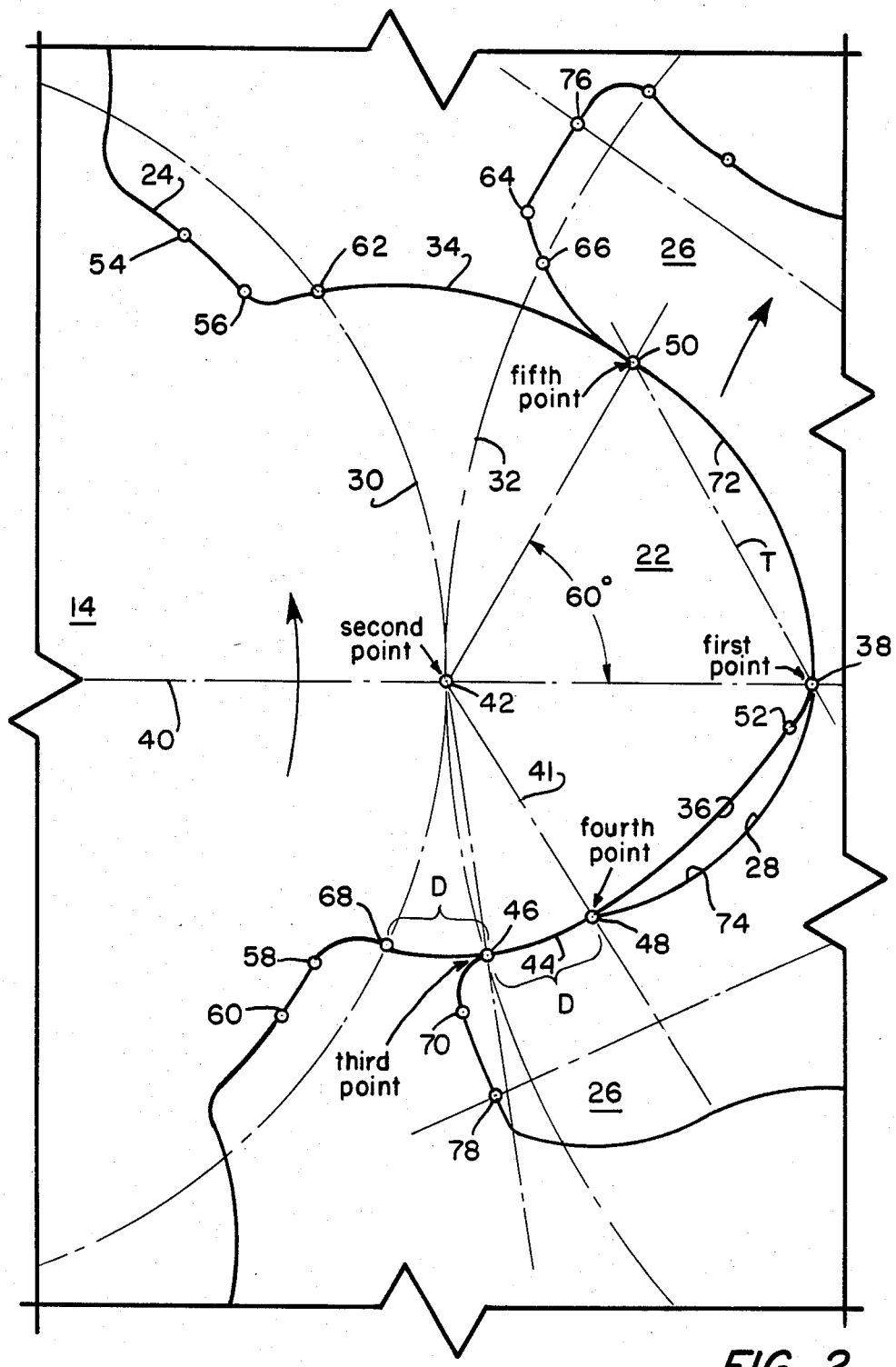
FIG. 2 is an enlarged, line drawing of the rotors of FIG. 1, and only mating surfaces thereof, this view showing the profile improvements in greater clarity.

Each female rotor grooves 28 has a pair of generally concave surfaces 72 and 74, and a first, radially innermost point which, in FIGS. 1 and 2, confronts point 38, and is intermediate surfaces 72 and 74. The circular arc portion, between points 50 and 38 subtends approximately sixty degrees. With the aforesaid line 40 traversing the axial center 20 and point 38, it retraces its traverse of point 42. Point 42 is also located on the pitch cycle 32 (as well as on pitch circle 30). A minor portion of surface 74 which, in FIGS. 1 and 2, confronts portion 44 of the male rotor 14, is defined by the same circular arc, substantially, which defines portion 44, has its origin at point 42, and traverses the pitch circle 30 (and 32). This minor portion of surface 74 is equal in length to portion 44 of the male rotor. The circular arc, defining the aforesaid minor portions of surfaces 36 and 74, extends through approximately twenty degrees. Too, points 68 and 46, on the male rotor lobes, subtend an arc of approximately twenty degrees.

Each female rotor lobe and groove is further defined as follows; for the purposes of the ensuing description, given profile points identified on the male rotor 14 (i.e., points 50, 38, 48 and 46) shall be deemed to subsist on the female rotor 16. The profile portion of each groove of the female rotor, from first point 38 to fifth point 50 is a circular arc with its radial center at second point 42 on pitch circle 32. Its radius is substantially the same as that of the arc drawn from second point 42 to define that portion of the male rotor lobe 22 which also extends between points 38 and 50. The female rotor portion extending between points 50 and 66 is an involute tangent to the arc subsisting between points 38 and 50. The portion between points 64 and 76 is a circular arc drawn from axis 20. The portion bridging between points 64 and 66 is an elliptical arc tangent to both the contiguous involute and circular arc portions. Between points 38 and 48, the portion thereat is a generated configuration, the same being generated by the portion of the male rotor which extends between points 38 and 52. The portion between points 70 and 78 is another circular arc drawn from axis 20. Finally, the portion between point 70 and 46 is an elliptical arc tangent to the latter circular arc and passing through points 46.

Again, as it may contribute to a fuller understanding of the distinctive female rotor profile, the following is a tabulation of the profile portions:

76–64, a circular arc drawn from axis 20;
64–66, an elliptical arc;
66–50, an involute;
50–38, a circular arc drawn from point 42;
38–48, a generated portion;
48–46, a circular arc drawn from point 42;
46–70, an elliptical arc; and
70–78, a circular arc drawn from axis 20.

The first and second points 38 and 42 are substantially equidistant from the fifth point 50 most adjacent thereto. Too, points 38, 42, and the point 50 most adjacent thereto define apexes of that which is substantially an equilateral triangle "T". Further, a line 41 originating at second point 42 and passing through the fourth point 48 traverses the fifth point 50 of an adjacent groove 28 when, as shown in FIG. 1, line 40 joins axes 18 and 20 and passes through first and second points 38 and 42.

The rotors 14 and 16, thus described, are asymmetrical. Surfaces 36 and 74 are of differing arcuate conformations, due to the designed asymmetry and define a void "V" therebetween. The void "V" is of varying width, having a somewhat of a crescent shape. Superficially, rotors 14 and 16 may appear to be not significantly distinguished from the rotors defined in my referenced, prior U.S. Pat. No. 4,412,796. For instance, the female rotors in both the aforesaid patent and in the instant invention, have grooves which comprise, in sequence, an elliptical arc, an involute, a circular arc, and a generated arc. The instant rotors, however, have most significant differences, and the novelty thereof, and the advances accruing therefrom, can best be understood by examination of FIGS. 3 and 4 (together with FIGS. 1 and 2).

With typical asymmetrical rotors, including those set out in my U.S. Pat. No. 4,412,796, employed for female rotor drive, the theoretical drive thereof is through that which is substantially a line contact 80 on the trailing side of the female rotor groove 82 (FIG. 3). Of course, this would give an infinitely high stress. Accordingly, in actuality, the rotors' material yieldably deforms somewhat to define a substantially conforming, albiet limited, area 84 therebetween. Even with such limited, deformed, somewhat conforming area 84, the stresses thereat can be unacceptably high. Consequently, the rotors have to be formed of specially hardened material. According to my invention, the rotors 14 and 16 are designed with conforming surfaces which accommodate for female rotor drive, and avoid unwarranted material deformation.

Machine 10, as disclosed herein for exemplary purposes, comprises an air compressor. Now, as is conventional in this technology, machine 10 is designed to be oil flooded. This means, of course, that fine sprays of oil are injected into machine 10, between the meshing rotors 14 and 16, for cooling and sealing purposes. (Such oil injection, being well known to those skilled in this art, is not shown.) Now then, as a lobe 22 and groove 24 come into mesh, they come into near contacting engagement. There obtains therebetween an exceedingly fine clearance. Such clearance is occupied by films of oil on the lobe 22 and in the groove 24. Drive, then, from one rotor to the other, is actually through such oil film as remains therebetween when the relevant, near-contacting surfaces close upon each other. A unique feature of my invention, vis-a-vis the prior art, which pertains to such sealing oil film, can be appreciated by studying FIGS. 3 and 4.

As the lobe 26' of the female rotor 16' closes upon the confronting surface of lobe 22' of the male rotor (FIG. 3), there occurs therebetween the aforesaid line contact 80—through the intervening oil film. It will be appreciated, of course that the "line" of contact, under the lobe-to-lobe driving force, cannot retain any appreciable film of oil. Such is squeezed and displaced to both sides of line contact 80, and dispersed outwardly, as well, from the yieldably forming area 84. This is due to the fact that the mating, lobe-to-lobe surfaces are non-conforming. In FIG. 4, then, the aforesaid unique feature or improvement of my invention is depicted.

FIG. 4 clearly highlights the limited, circular arc portions, of the novel rotors 14 and 16, which obtain between third point 46 and fourth point 48. Too, as projected, it can be seen that the drive contact area between the rotors is defined as a diamond-shaped area 86. Contact stress, then, between the rotors is finite before any material deformation occurs, because of the presence of an oil film between the mating, conforming surfaces. The minute clearance obtaining between the rotors, between third and fourth points 46 and 48, retains a film of oil therein. The oil, being essentially incompressible, distributes the contact force over the diamond-shaped area 86. As a consequence, the rotors 14 and 16 are formed of less expensive material of only standard hardness.

In a typical machine (i.e., air compressor) having a four-lobed male rotor 14 and a six-lobed female rotor 16, there obtain, always, at least three of these broad contact areas 86. As the rotors rotate, the areas 86 move axially to disappear or separate at the discharge end while new areas 86 form at the inlet end. Consequently, depending upon the angle of rotation in the machine, at any one instant there may be four areas 86 formed and bearing the load. The conforming areas 86 offer a further benefit. The expanse of the substantially common radius, and diamond-shape surfaces accommodate therein a greater, corresponding expanse of the film of sealing oil. In turn, such an expanse of oil film helps to reduce any shearing stresses visited on the rotors 14 and 16. Additionally, the breadth of areas 86-considerable breadth vis-a-vis a line contact—offers a marked improvement in rotor-to-rotor sealing.

Reverting to FIG. 4, the diminishing-radii portion of the male rotor, the portion between first point 38 and point 52 is shown. This limited arc generates the concave surface of the female rotor 16 which obtains between first point 38 and fourth point 48. Point 52 generates fourth point 48 on the female rotor, while the first point(s) 38, on the male and female rotors, are of substantially common radial dimension (from axis 18). During rotation, then, point 52 comes into sealing engagement with fourth point 48 on the female rotor groove and travels along surface 74 until the first points 38 sealingly coincide. This greatly enhances sealing, along the coacting lobe and groove, as compared to prior art, substantially line contact sealing surfaces theralong.

While I have described my invention in connection with a specific embodiment thereof, it is to be clearly understood that this is done only by way of example, and not as a limitation to the scope of my invention, as set forth in the objects thereof and in the appended claims.

I claim:

1. A rotor, having helical lobes, and intervening, helical grooves, rotatable about a given axis within a machine housing, for coacting, meshing engagement with a cooperating rotor also having helical lobes, and intervening, helical grooves, in order that fluid admitted into such housing will be received in said grooves and, due to coacting, meshing engagement and rotation of said rotors, will have the pressure thereof altered, wherein:

said rotor has an axial center;

each of said grooves of said rotor has, in cross-section, a pair of generally concave surfaces, and a first, radially innermost point intermediate said pair of surfaces;

and said rotor has a pitch circle; wherein a line traversing said axial center and said first point further traverses a second, given point on said pitch circle;

only a minor portion of one of said concave surfaces is defined by a circular arc which (a) traverses said pitch circle, and (b) has a given radius originating at said second point; and said minor portion is bounded by a third point which is located on said pitch circle whereat said arc traverses, and a fourth point which is at a prescribed distance inward of said pitch circle.

2. A rotor, according to claim 1, wherein:

said minor portion comprises an arc of approximately twenty degrees.

3. A rotor, according to claim 1, wherein:

a major portion of each of the other of said concave surfaces is defined by another circular arc which traverses said pitch circle and has a prescribed radius originating at said second point; and said major portion is bounded by (a) said first point, and (b) a given fifth point, located along said other concave surface, which is spaced apart from, and radially outward of, said first point; wherein a line drawn from said given second point, and traversing said fourth point, substantially traverses another such fifth point of the major portion of the other of said concave surfaces of an adjacent one of said grooves.

4. A rotor, according to claim 3, wherein:

said first and second points are substantially equally distant from said given fifth point.

5. A rotor, according to claim 3, wherein:

said first and second points and said given fifth point define apexes of a substantially equilateral triangle.

6. A rotor, according to claim 1, wherein:

a major portion of said one concave surface comprises an arcuate surface of varying curvature, the same being bounded by the fourth point at one end, and the first point at the opposite end and, therefore, is contiguous with said minor portion at said one end.

7. A rotor, according to claim 6, wherein:

a major portion of each of the other of said concave surfaces is defined by another circular arc which traverses said pitch circle and has a prescribed radius originating at said second point; and said major portion is bounded by (a) said first point and, therefore, is contiguous with said arcuate surface of varying curvature, and (b) a fifth point, located along said other concave surface, which is spaced apart from, and radially outward of, said first point.

8. A rotor, according to claim 7, wherein:

each of said grooves has a convex portion which is contiguous with said major portion of said other surface at one end thereof, and extends to said pitch circle at the opposite end thereof; and said convex portion comprises an involute tangent to said latter major portion at said one end thereof.

9. A rotor, having helical lobes, and intervening, helical grooves, rotatable about a given axis within a machine housing, for coacting, meshing engagement with a cooperating rotor also having helical lobes, and intervening, helical grooves, in order that fluid admitted into such housing will be received in said grooves and, due to coacting, meshing engagement and rotation of said rotors, will have the pressure thereof altered, wherein:

said rotor has an axial center;

each of said lobes of said rotor has, in cross-section, a pair of generally convex surfaces, and a radially outermost point intermediate said pair of surfaces; and said rotor has a pitch circle; wherein a line traversing said axial center and a first point defined by said radially outermost point of said lobe further traverses a second, given point on said pitch circle;

only a minor portion of one of said convex surfaces is defined by a circular arc which (a) traverses said pitch circle, and (b) has a given radius originating at said second point; and said minor portion commences at a third point, along said one convex surface, which is at a prescribed distance outward from said pitch circle, and subsists along a length of said arc, which length is of the same dimension as said prescribed distance, to a fourth point along said one convex surface.

10. A rotor, according to claim 9, wherein:

said minor portion comprises an arc of approximately twenty degrees.

11. A rotor, according to claim 9, wherein:

a major portion of said one convex surface comprises an arcuate surface which is contiguous with said minor portion at one end thereof, and extends to near adjacency to said first point at the other end thereof; and said arcuate surface is defined of a family of radii which radii, measured from said second point, increase exponentially from said one end to said other end.

12. A rotor, according to claim 9, wherein:

said one convex surface is further defined by an epicycloid-shaped portion subsisting along a length equal to said prescribed distance which extends outward from said pitch circle; and said latter portion subtends an arc, drawn from said second point, of approximately twenty degrees.

13. A rotor, according to claim 9, wherein:

a major portion of each of the other of said convex surfaces is defined by another circular arc which traverses said pitch cycle and has a prescribed radius originating at said second point; and said major portion is bounded by (a) said first point, and (b) a fifth point located along said other convex surface which is spaced apart from, and radially inward of, said first point.

14. A rotor, according to claim 13, wherein:

said first and second points are substantially equally distant from said fifth point.

15. A rotor, according to claim 13, wherein:

said first, second and fifth points define apexes of a substantially equilateral triangle.

16. A rotary, positive displacement machine, having a housing, adapted to handle a working fluid in that it has rotors rotatable about parallel axes, within said housing, said rotors each having helical lobes and intervening, helical grooves, for coacting, meshing engagement in order that fluid admitted into said housing will be received in said grooves and, due to coacting, meshing engagement, and rotation, of said rotors, will have the pressure thereof altered, wherein:

each of said rotors has an axial center;

each of said grooves of one of said rotors has, in cross-section, a pair of generally concave surfaces and a radially innermost point intermediate said concave surfaces;

each of said lobes of another of said rotors has, in cross-section, a pair of generally convex surfaces and a radially outermost point intermediate said convex surfaces;

and said rotors have pitch circles; wherein a line traversing said axial center, and both said innermost and outermost points, at a first, common, point of coincidence, further traverses a second, given point common to both of said pitch circles;

only a minor portion of one of said concave surfaces and only a minor portion of one of said convex surfaces are both defined by a circular arc which (a) traverses said pitch circles of said rotors, and (b) has a given radius originating at said second point; and said minor portions are bounded by a third point located on said pitch circle of said one rotor whereat said arc traverses, and a fourth point which is at a prescribed distance inward of said pitch circle of said one rotor.

17. A rotary, positive displacement machine, having a housing, adapted to handle a working fluid in that it has rotors rotatable about parallel axes, within said housing, said rotors each having helical lobes and intervening, helical grooves, for coacting, meshing engagement in order that fluid admitted into said housing will be received in said grooves and, due to coacting, meshing engagement, and rotation, of said rotors, will have the pressure thereof altered, wherein:

each of said rotors has an axial center;

each of said grooves of one of said rotors has, in cross-section, a pair of generally concave surfaces and a radially innermost point intermediate said concave surfaces;

and each of said lobes of another of said rotors has, in cross-section, a pair of generally convex surfaces and a radially outermost point intermediate said convex surfaces; wherein a major portion of one of said concave surfaces defines a first arc;

a major portion of one of said convex surfaces defines a second arc;

said major portions are in confronting relationship, and define a void of varying width therebetween;

a minor portion of said one concave surface is defined of a given conformation;

a minor portion of said one convex surface is defined of the same aforesaid given conformation;

said minor portions are in confronting relationship and define only a minute clearance therebetween, of substantially uniform dimension therealong.

18. A rotary, positive displacement machine, according to claim 17, wherein:

said minor portions subtend an arc, drawn from a point originating at one of said lobes, of approximately twenty degrees.

19. A rotor, positive displacement machine, according to claim 17, wherein:

a major portion of the other of said convex surfaces defines a circular arc subtending approximately sixty degrees.

20. A rotary, positive displacement machine, according to claim 17, wherein:

said rotors have pitch circles; and a line traversing said axial centers, and both said innermost and outermost points at a first, common, point of coincidence, further traverses a second, given point common to both of said pitch circles; and said minor portions are both defined by a circular arc which (a) traverses both of said pitch circles, and (b) has a given radius originating at said second point.

21. A rotary, positive displacement machine, according to claim 20, wherein:

said minor portion of said one concave surface has a first termination at a prescribed distance from said pitch circle of said one rotor; and said minor portion of said one convex surface has a first termination at a same aforesaid prescribed distance from said pitch circle of said another rotor.

22. A rotary, positive displacement machine, according to claim 20, wherein:

said minor portion of said one concave surface has a second termination at said pitch circle of said one rotor.

* * * * *